United States Patent [19]

Urban

[11] Patent Number: 4,820,904

[45] Date of Patent: Apr. 11, 1989

[54] ELECTRICAL CONTACTING DEVICE FOR FUSING ROLLER

[75] Inventor: Carl T. Urban, Hilton, N.Y.

[73] Assignee: Eastman Kodak Company, Rochester, N.Y.

[21] Appl. No.: 115,322

[22] Filed: Nov. 2, 1987

[51] Int. Cl.[4] ..... H05B 3/46

[52] U.S. Cl. ..... 219/216; 219/469; 355/3 FU

[58] Field of Search ..... 219/216, 469, 470, 471, 219/244; 355/3 FU, 14 FU

[56] References Cited

U.S. PATENT DOCUMENTS

| | | | |
|---|---|---|---|
| 1,596,181 | 8/1926 | Hills | 219/244 |
| 2,870,312 | 1/1959 | Westervelt | 219/216 |
| 3,471,683 | 10/1969 | Bogue | 219/469 |
| 3,637,984 | 1/1972 | Irvine | 219/471 |
| 4,034,189 | 7/1977 | Sakamaki | 219/216 |
| 4,109,135 | 8/1978 | Minden et al. | 219/216 |
| 4,395,109 | 7/1983 | Nakajima | 355/3 FU |
| 4,468,069 | 8/1984 | Meal | 219/471 |
| 4,544,828 | 10/1985 | Shigenobu | 219/216 |
| 4,628,183 | 12/1986 | Satomura | 355/3 FU |

FOREIGN PATENT DOCUMENTS

| | | |
|---|---|---|
| 0240730 | 3/1987 | European Pat. Off. . |
| 0241714 | 3/1987 | European Pat. Off. . |

OTHER PUBLICATIONS

*Research Disclosure,* Jul. 1982, No. 21945, "Resistivity Heated Fuser Roller".

*Primary Examiner*—Teresa J. Walberg
*Attorney, Agent, or Firm*—Leonard W. Treash, Jr.

[57] ABSTRACT

A fusing roller of the type having a thin internal resistance heating layer is electrically contacted by an internal conductive annular element positioned adjacent the end of the roller core. The resistance layer is applied to a common surface formed by the outside of the core and the annular element. Preferably, the resistance layer is covered by a protective layer. With this structure, the contacting device is protected from external damage, for example, from that caused by release oil contamination.

10 Claims, 2 Drawing Sheets

ELECTRICAL CONTACTING DEVICE FOR FUSING ROLLER

RELATED APPLICATION

This application is related to co-assigned U.S. patent application Ser. No. 07/139,994, entitled Fusing Roller, filed concurrently herewith, in the names of Carl T. Urban, Mark A. Lewis and David A. Glocker.

TECHNICAL FIELD

This invention relates to electrostatography, and more particularly to a device for electrically contacting the resistive heating layer of a fusing roller.

BACKGROUND ART

U.S. Pat. No. 4,395,109 describes a roller fusing mechanism for fusing toner to paper or another substrate in which a thin resistive heating layer connectable to an electrical power supply is positioned close to the surface of a fusing roller. The resistive heating layer is insulated from a metal core and is covered by a protective layer having an abhesive fusing surface. This type of structure permits the heat generated within the resistive heating layer to be conducted rapidly and efficiently to the fusing surface. Consequently, the surface temperature can be controlled more accurately and the power requirement for the fusing mechanism is reduced.

In this prior structure, electrical contact is provided to the resistive heating layer by copper conductive elements of substantial thickness positioned on the surface of the roller in a location at which the resistive heating layer is uncovered by the protective layer. These conductive elements are electrically contacted as the roller rotates, by brushes or the like connected to the power supply.

Sizeable conductive elements of this type are readily contactable, but interfere with other aspects of the apparatus. For example, most fusing rollers need the application of a release oil to prevent offset of toner in operation. Oil can corrode the conductive elements and the elements themselves can provide a conduit for oil to travel deeper into the roller where it can cause damage.

DISCLOSURE OF THE INVENTION

It is the object of the invention to provide a fusing roller generally of the type described, but which can be connected to a power supply with less damage from release liquid or other outside agents.

This and other objects are accomplished by an electrical contacting structure which is internal to the roller and protected from oil and other problems. The contacting structure includes a conductive annular element around the fusing roller which contacts the inner surface of the resistive heating layer and means for electrically connecting the conductive annular element to the power supply. According to a preferred embodiment, the fusing roller has a core with an insulative surface. The conductive annular element adjoins the core and forms a continuous cylindrical surface with the insulative surface. The resistive heating layer is supported by and contacts the continuous cylindrical surface.

BEST MODE OF CARRYING OUT THE INVENTION

Figure 1:
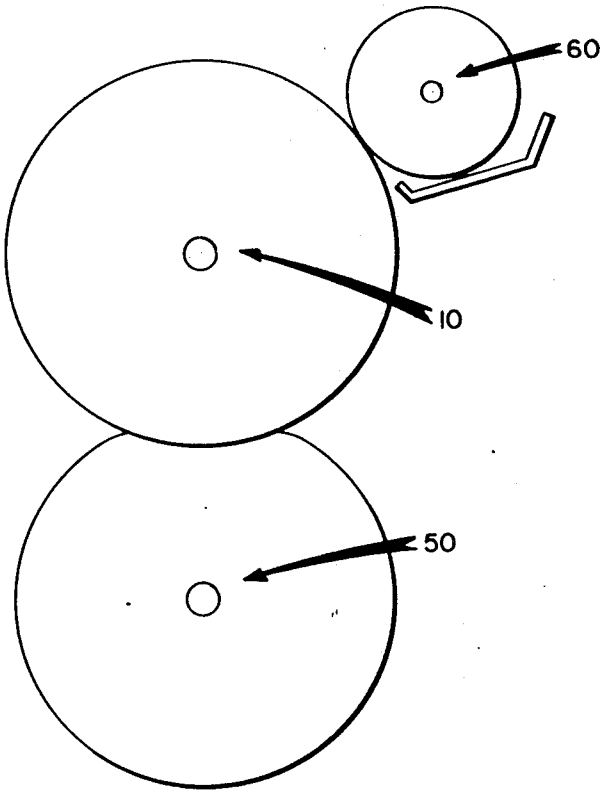
FIG. 1 is a schematic end view of a fusing apparatus using the fusing roller of FIG. 2.

According to FIG. 1 a fusing roller 10 is part of a fusing mechanism of a type well known in the art. The fusing mechanism includes a pressure roller 50 for providing a heating nip and a wicking mechanism 60 for applying release oil to prevent toner offset onto the fusing roller.

Figure 2:
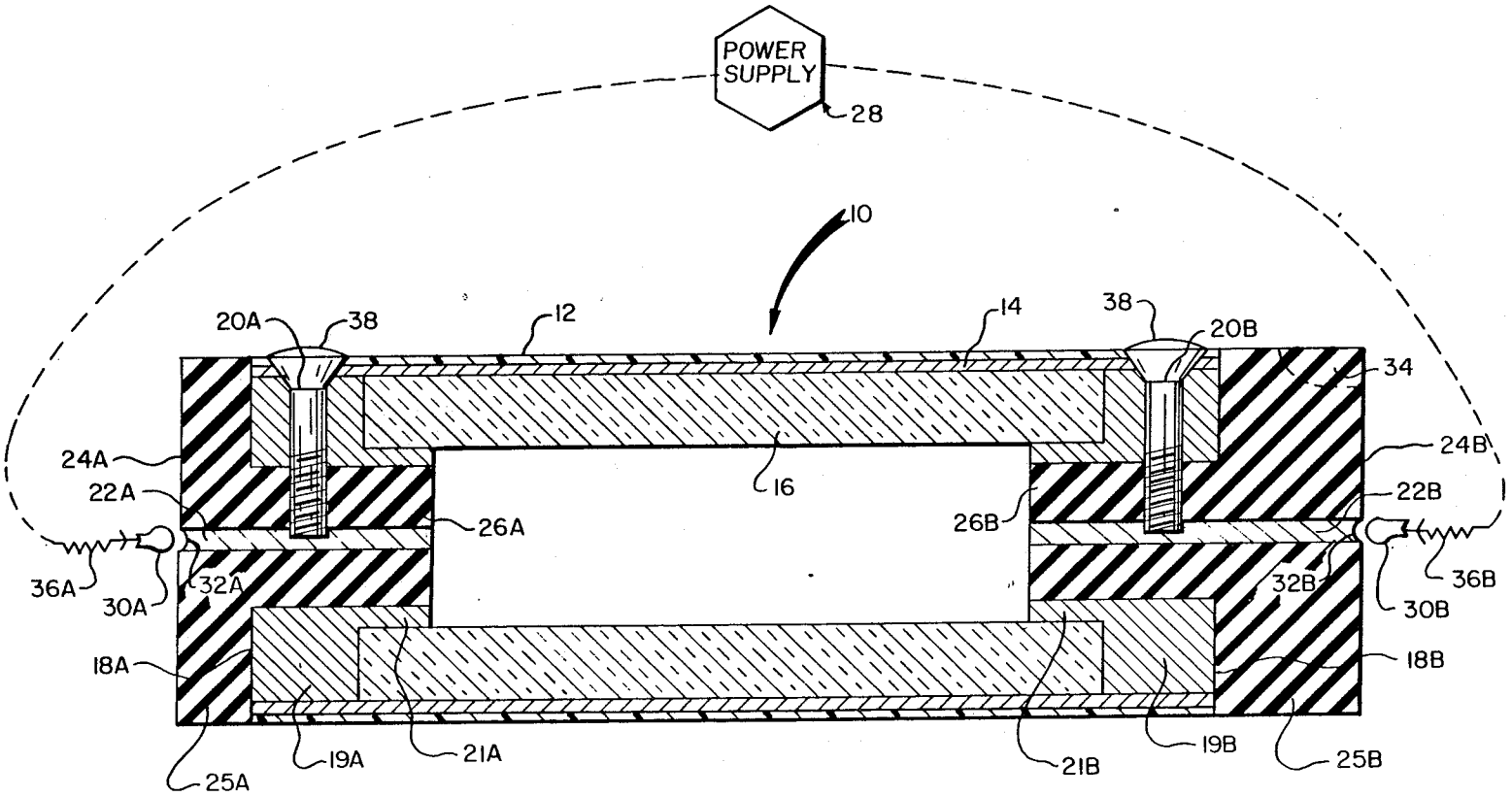
FIG. 2 is a side section of a fusing roller constructed according to the invention.

FIG. 2 shows the fusing roller 10 comprising a core 16, a resistive heating layer 14, and a protective layer 12 providing a fusing surface. The resistive heating layer is positioned between the core and the protective layer. To limit heat loss and electrical shorting at the core 16 of the fusing roller, the surface of core 16 is both thermally and electrically insulative, for example, the entire core can be of glass or another insulative material or a layer of insulative material can be positioned between the core and the heating layer 14.

Resistive heating layer 14 is electrically connected to a power supply 28 through an electrical contacting structure. This structure provides thorough contact which allows electrical current to be evenly distributed to the resistive heating layer 14. This electrical contacting structure includes conductive annular elements, such as ring 18A and 18B, which provide broad area contact with layer 14. Conductive annular elements 18A and 18B adjoin core 16 and comprise sections 19A and 19B with outside diameters corresponding to the outside diameter of the insulative surface on core 16, and annular extensions 21A and 21B with outside diameters corresponding to the inside diameter of the core 16. Conductive cylindrical elements such as plugs 22A and 22B, are positioned at the axis of fusing roller 10 and are connected to conductive rings 18A and 18B by connecting means, for example, screws 20A and 20B. The heads of screws 20A and 20B are covered with a protective material 38 to decrease release oil damage and provide insulation.

Insulative annular elements 24A and 24B, for example rings made from a phenolic material, support conductive plugs 22A and 22B and protect the roller ends and the conductive rings 18A and 18B from heat loss and release oil damage. Insulative rings 24A and 24B comprise sections 25A and 25b having outside diameters which correspond to the outside diameter of the fusing roller 10, and annular extensions 26A and 26B whose outside diameters correspond to the inside diameter of the conductive rings 18A and 18B.

The electrical current needed to heat the resistive heating layer 14 is supplied by the power supply 28. Electrical contact between the power supply 28 and the conductive plugs 22A and 22B can be accomplished by any known axial connecting mechanism. A preferred design is shown in FIG. 2 and includes ball conductors 30A and 30B which are urged by springs 36A and 36B into relative, sliding rotational movement with hemispherical cavities 32A and 32B in the ends of conductive plugs 22A and 22B.

In operation, electrical current provided by the connected power supply 28 flows through ball conductors 30A and 30B, conductive end plugs 22A and 22B, screws 20A and 20B, conductive rings 18A and 18B, and resistive heating layer 14. The resistive heating layer materials, in response to the electrical current flow, produce the desired heating effect of the fusing roller 10. The insulative core 16 and insulative rings 24A and 24B minimize heat loss within the system.

The contacting structure eliminates several problems associated with the external contacting structure of the prior art. The release oil usually required in electrostatographic fusing systems often collects on and corrodes the external conductive brushes. This inhibits the electrical contact needed to maintain the required current flow, and thus alters the fusing roller surface temperature. The external contacting structure also acts as a conduit for release oil, allowing the oil to penetrate and damage the fusing roller materials. In addition, the external contacting structure is directly exposed to the operating environment which increases the required operating space, and the possibilities of mechanical and electrical malfunctions such as element deterioration and electrical shorting.

The internal electrical contacting structure shown in FIGS. 1 and 2 is almost entirely insulated and protected from the release oil and the operating environment. Therefore, the problems of element corrosion and fusing roller damage due to release oil are decreased. The possibilities for mechanical and electrical malfunctions are decreased because the majority of the contacting structure is housed within the fusing roller. Improved electrical contact is maintained because the axially located conductors connecting the power supply 28 to the conductive end plugs 22A and 22B are positioned at each end of the fusing roller and consequently, less exposed to the release oil. In addition, the required operating space is reduced.

Electrical continuity of the resistive heating layer 14 maintains uniformity of the heat applied to the surface to be fused. Damage to the resistive heating layer, such as cracking, will occur if the resistive heating layer becomes separated from the core during manufacture or use. Fusing roller materials having dissimilar thermal expansion coefficients will experience varying amounts of expansion when heated during manufacture or use, thus increasing the possibility of resistive heating layer and core separation. For example, the curing process in applying the outer protective layer 12 may require a high temperature which invites such separation. Therefore, materials used for the resistive heating layer and core should exhibit excellent bonding characteristics and have similar coefficients of thermal expansion.

Many metallic or metallic alloy resistive layer materials which have resistive properties particularly useful in this type of fusing roller have a coefficient of thermal expansion between $30\times10^{-7}$ to $120\times10^{-7}$ linear distance per distance per degree C. Most glass compositions also fall in this range. Thus, glass is an excellent material to be used for the core. One or more glasses can be matched with each resistive material in this respect.

The preferred embodiment shown in the FIGS. includes a resistive heating layer made from a metal alloy of about 29% nickel and 71% iron. Because of a close match in thermal expansion properties, this alloy maintains excellent bonding with a core made of an alkali barium borosilicate glass. However, many other usable materials also bond well with the same or other glasses. For example, a tungsten resistive heating layer matches well with a borosilicate, soda borosilicate, or soda lime borosilicate glass core. Titanium resistive heating layers are applied to potash soda lime or alkali barium glass cores, and tantalum resistive heating layers are used with lead borosilicate, soda zirconia, or soda borosilicate glass cores. Resistive heating layers made of certain carbon steels are applied to glass cores made of potash soda lime, or potash lead. Stainless steels containing 17% and 28% chromium are applied to glass cores made of potash lead, alkali barium, or soda potash lead. A metal alloy containing approximately 42% nickel, 6% chromium, and 52% iron is applied to glass cores made from potash soda lead, soda lime, potash lead, lead zinc borosilicate, alkali barium, alkali lead, or soda barium fluoride. Glass cores made of alkali barium borosilicate, alkali borosilicate, soda borosilicate, borosilicate, aluminosilicate, alkali earth aluminosilicate also maintain the desired bonding and thermal expansion properties when coated with a resistive heating layer made of molybdenum. These cores also bond well with metal alloys containing approximately (1) 29% nickel and 71% iron, (2) 40.5–41.75% nickel-cobalt and 59.5–58.25% iron, and (3) 17% cobalt and 83% iron.

The thickness of the resistive heating layer is dependent on the composition of the material used and the amount of available power. For example, when the resistive heating layer 14 is made of the preferred nickel-iron alloy its thickness can range from 0.1 microns to 0.3 microns.

The protective layer 12 includes at least one material that provides good toner release properties, for example, silicone rubber or polytetrafluoroethylene, as is well known in the art. For example, a protective layer of polytetrafluoroethylene having a thickness ranging from 1.0 mils to 2.0 mils gives good results when coated directly on the preferred nickel-iron alloy resistive heating layer previously coated on an alkali barium borosilicate glass core.

Manufacture of the described fusing roller includes completely inserting annular extensions 21A and 21B of conductive rings 18A and 18B into each end of core 16. The outside surfaces of sections 19A and 19B of conductive rings 18A and 18B form a continuous surface with the outside surface of the core 16. The method for joining these components is dependent on the types of materials used. For example, thermal properties of a glass core and conductive rings made of a nickel-iron alloy are similar; therefore, permanent contact between the core 16 and conductive rings 18A and 18B can be established by means such as welding.

The resistive heating layer 14 is then applied as a coating to the continuous surface formed by the core 16 and attached conductive rings 18A and 18B, for example, by sputtering. Once the desired resistive heating layer thickness is obtained, the outside surface of the resistive heating layer 14 is cleaned, for example, by chemical etching. Bonding strength between the resistive heating layer 14 and the protective layer 12 is further increased by this cleaning process. The protective layer 12 is then applied over the entire exposed surface of the resistive heating layer 14, for example, by spraying.

Annular sections 26A and 26B of insulative rings 24A and 24B are then completely inserted into the centers of conductive rings 18A and 18B respectively. The continuous outside surface of the fusing roller is maintained by the outside surfaces of sections 25A and 25B of insulative rings 24A and 24B. Section 25B of ring 24B has a larger axial width than section 25A of ring 24A in order to accommodate means for driving the fusing roller, such as slot 34 in which a drive gear is mounted. Conductive end plugs 22A and 22B are then inserted into the centers of the insulative rings 24A and 24B, extending into the portions 26A and 26B to provide additional support to the fusing roller 10.

Electrical contact between the conductive end plugs 22A and 22B and the conductive rings 18A and 18B is established by inserting conductive means such as screws 20A and 20B into the ends of the fusing roller 10 from the outer surface of said roller toward the axis of the core 16. These screws 20A and 20B pass through and contact the resistive heating layer 14, conductive rings 18A and 18B, insulative rings 24A and 24B, and extend into the conductive end plugs 22A and 22B respectively. The exposed heads of screws 20A and 20B are protected from the operating environment by a coating 38, such as silicone rubber.

After the means for driving the fusing roller, such as a drive gear is attached to the insulating ring 24B by means of slot 34, the completed fusing roller 10 is mounted into an electrophotographic machine by conventional mounting means and connected to the power supply by snapping the spring mounted ball conductors 30A and 30B into the hemispherical cavities 32A and 32B, located on the ends of the conductive end plugs 22A and 22B.

The invention has been described in detail with particular reference to a preferred embodiment thereof, but it will be understood that variations and modifications can be effected within the spirit and scope of the invention as described hereinabove and as defined in the appended claims.

I claim:

1. A fusing roller of the type having an inner base core with an insulative outer surface for supporting fusing roller layers including an outer protective layer and a resistive heating layer disposed between said insulative surface and said outer protective layer, said roller having an electrical contacting structure for providing electrical continuity between a power supply and the resistive heating layer, characterized in that said contacting structure includes:

a conductive annular element adjoining an end of said core to form a substantially continuous cylindrical surface with said insulative surface, which continuous cylindrical surface contacts and supports an inner surface of said resistive heating layer; and means for electrically connecting said conductive annular element to the power supply.

2. A fusing roller of the type having an inner base core for supporting fusing roller layers including an outer protective layer providing a fusing surface and a thin resistive heating layer coated on said core and disposed between said core and said outer protective layer, said roller having an electrical contacting structure for providing electrical continuity between a power supply and the resistive heating layer, characterized in that said containing structure includes:

a conductive annular element in said fusing roller having a surface upon which a portion of said resistive heating layer is coated; and means for electrically connecting said conductive annular element to the power supply.

3. A fusing roller according to claim 1, wherein said resistive heating layer is a coating on said continuous cylindrical surface.

4. A fusing roller according to claim 1, wherein said protective layer provides a fusing surface.

5. A fusing roller according to claim 1, wherein said conductive annular element is at least partially protected by an insulative annular element.

6. A fusing roller according to claim 5, wherein said means for electrically connecting said conductive annular element to the power supply includes:

a conductive cylindrical element positioned at the axis of said insulative annular element, said conductive cylindrical element being rotatable with said core and being slidably contactable by stationary means electrically associated with the power supply; and a conducting means connecting said conductive annular element to said conductive cylindrical element.

7. A fusing roller according to claim 6, wherein said conductive cylindrical element is positioned inside and along common axes of said insulative annular element, conductive annular element, and core, is rotatable with said core, and has at an end thereof, a hemispherical cavity shaped to accept a nonrotatable ball contact electrically associated with said power supply.

8. A fusing roller according to claim 6, wherein said conductive means for connecting said conductive annular element and said conductive cylindrical element is a screw inserted from the outer surface of said roller toward the axis of the core and contacting said resistive heating layer, conductive annular element, and conductive cylindrical element.

9. A fusing roller according to claim 5, wherein said insulative annular element is a ring with an axis common with the axes of said conductive annular element and said core.

10. A fusing roller of the type having an inner base core for supporting fusing roller layers including an outer protective layer and a resistive heating layer disposed between said core and said outer protective layer, said roller having an electrical contacting structure for providing electrical continuity between a power supply and the resistive heating layer, characterized in that said contacting structure includes:

a conductive annular element in said fusing roller having an axis common with the axis of the core and including an annular extension seated within the core, which element contacts the inner surface of said resistive heating layer; and means for electrically connecting said conductive annular element to the power supply.

* * * * *